US007593675B2

(12) United States Patent
Kimura et al.

(10) Patent No.: US 7,593,675 B2
(45) Date of Patent: Sep. 22, 2009

(54) COLOR IMAGE FORMING APPARATUS HAVING A DISCHARGING UNIT TO DISCHARGE AN ELECTRICAL CHARGE OF A TONER IMAGE TRANSFERRED ON AN INTERMEDIATE TRANSFER MEMBER

(75) Inventors: Takenobu Kimura, Hachioji (JP); Yotaro Sato, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 196 days.

(21) Appl. No.: 11/519,113

(22) Filed: Sep. 11, 2006

(65) Prior Publication Data

US 2007/0147908 A1 Jun. 28, 2007

(30) Foreign Application Priority Data

Dec. 26, 2005 (JP) ..... 2005-371677

(51) Int. Cl.
*G03G 15/16* (2006.01)

(52) U.S. Cl. ..... 399/296; 399/302; 399/308

(58) Field of Classification Search ..... 399/66, 399/296, 298, 299, 302, 308
See application file for complete search history.

(56) References Cited

U.S. PATENT DOCUMENTS 6,440,515 B1 * 8/2002 Thornton et al. ..... 428/58

FOREIGN PATENT DOCUMENTS

| | | |
|---|---|---|
| JP | 06-236116 | 8/1994 |
| JP | 10-274892 | 10/1998 |
| JP | 11-143255 | 5/1999 |

* cited by examiner

*Primary Examiner*—Hoan H Tran
(74) *Attorney, Agent, or Firm*—Cantor Colburn LLP

(57) ABSTRACT

A color image forming apparatus includes: a plurality of image carriers each on which a toner image having a color different from each other is formed; an intermediate transfer member to which each of the image carriers is transferred; a plurality of a primary transfer units each which transfers a toner image formed on each of the plurality of image carriers onto the intermediate transfer member; a discharging unit provided between two adjoining image carriers in a moving direction of the intermediate transfer member, which discharges an electrical charge of a toner image transferred on the intermediate transfer member; and a secondary transfer unit which transfers a plurality colors of toner images which have been superimposed on the intermediate transfer member onto a transfer material.

10 Claims, 7 Drawing Sheets

COLOR IMAGE FORMING APPARATUS HAVING A DISCHARGING UNIT TO DISCHARGE AN ELECTRICAL CHARGE OF A TONER IMAGE TRANSFERRED ON AN INTERMEDIATE TRANSFER MEMBER

This application is based on Japanese Patent Application No. 2005-371677 filed on Dec. 26, 2005, which is incorporated hereinto by reference.

BACKGROUND OF THE INVENTION

The present invention relates to a copier, a printer, a facsimile machine and an image forming apparatus using an electro photography method having the functions of the copier, the printer and facsimile machine. Particularly, the present invention relates to a color image forming apparatus including an intermediate transfer member for superimposing plural color toner images onto the intermediate transfer member to form an image.

In the electro photography method color image forming apparatus using the intermediate transfer member, known is an image forming apparatus arranged to transfer a toner image formed on an image carrier, which is a photoreceptor onto the intermediate transfer member (primary transfer), then the toner image on the intermediate transfer member is transferred onto a transfer material (secondary transfer). In this type of color image forming apparatus, the color image forming apparatus is designed to superimpose an electrostatic toner image, which has been simultaneously formed on the image carrier with a predetermined polarity, onto the intermediate transfer member by using static electricity. Then static electricity transfers the toner image on the intermediate transfer member onto the transfer material at once.

The color image forming apparatus using the intermediate transfer member can superimpose the toner image formed on the image carrier onto the intermediate transfer member. Thus, the color image forming apparatus using the intermediate transfer member is widely applied to a color image forming apparatus. In this color image forming apparatus, after the toner image of each color formed on the image carrier is superimposed onto the intermediate transfer member, the superimposed toner images are transferred onto the transfer material at once by static electricity.

Since an electrostatic charge amount per a toner particle is substantially uniform, the toner layer voltage on the intermediate transfer member is determined by the toner adhesion amount in a predetermined area. In the color image forming apparatus, the electrostatic charge amount of the portion where toners of plural colors are superimposed among the toner images of the intermediate transfer member becomes larger than that of the portion where one color toner adheres. And for example, when there are a toner image of a solid portion and a toner image of a halftone portion on the intermediate transfer member, the electrostatic charge voltage of the solid portion is higher than that of halftone portion.

As described above, when toner image voltage dispersion on the intermediate transfer member is large, portions where transfer characteristics are different each other exist in the same toner image. When transferring all the portions where the transfer characteristics are different each other onto the transfer material under the same transfer condition, various poor quality images tend to appear when transferring the toner images from the intermediate transfer member to the transfer member.

In recent years, in the copier, the printer, the facsimile machine and the image forming apparatus such as a multifunctional product having the function thereof, the ratio of the machines having color capability has become high. At the same time, due to the adoption of polymerization toner and toner having a small diameter, the requirements for high quality images in a transfer process has become strong. Further, a high-speed process trend proceeds in the image forming apparatus. In response to these trends described above, in order to obtain a high quality image, it is necessary to correct the toner voltages on the intermediate transfer member, which vary according to the number of times of the first transfer and environment, so as to be substantially uniform, and to improve the second transfer performance.

Japanese Patent Application Publication No. 10-274892 discloses an image forming apparatus including a pre-transfer charging unit for charging a toner image onto an intermediate transfer member before conducting the second transfer to a transfer member.

Japanese Patent Application Publication No. 11-143255 discloses a potential difference controller to control a direct current voltage source of a secondary pre-transfer charging unit and a direct current voltage source of a secondary transfer device so that the difference between a toner image voltage of the secondary pre-transfer charging unit and a voltage of the second transfer device is substantially constant.

Japanese Patent Application Publication No. 06-236116 discloses an electro photography apparatus comprises a discharging unit for discharging a toner charge transferred onto an intermediate transfer member and a charging unit for charging the toner image on the intermediate transfer member with the same polarity when developing and to charge the toner image on the intermediate member with a reverse polarity against the charged polarity right before starting a second transfer.

In the color image forming apparatus for conducting the second transfer of a toner image from the intermediate transfer member to the transfer member after superimposing the toner image of each color formed on the surface of a photoreceptor onto the intermediate transfer member by using the first transfer unit, in order to prevent the occurrence of density unevenness due to the transfer charge deficit caused when the toner adhesive amount is large and the toner layer voltage is high, a secondary pre-transfer charging unit having a scorotron electrode is disposed on the upper stream of the second transfer unit to discharge the electrical charges of the toner image formed on the intermediate transfer member.

In this case, following is going to be a problem. Namely, when discharging the electrical charges of the toner image on the intermediate transfer member, the upper layer of the toner image turns to reverse electrical charge toner. As a result, floating toner adheres on a grid electrode having the same polarity of the toner before discharging the electrical charge of the toner image and the toner adhered on the grid deteriorates the dischargation control capability.

The color image forming apparatuses disclosed in Japanese Patent Application Publication No. 10-274892 and Japanese Patent Application Publication No. 11-143255 comprise a scorotron charging unit for charging electrical charges to form a toner image and removing the electrical charges, the scorotron charging unit being disposed in the upper stream of the second transfer unit. However, there is a possibility that floating toner adheres the grid electrode of the scorotron charging unit and deteriorates the control performance for charging the electrical charges.

The electro photography apparatus disclosed in Japanese Patent Application Publication No. 06-236116 is an apparatus wherein the electrical charges of a toner image is removed to zero by applying AC voltage, then toner image is recharged again. It is not an image forming apparatus in which a scorotron charging unit prevents the dirt of the grid in the scorotron charging unit. The charging unit disclosed here is a scorotron charging unit having no grid.

SUMMARY OF THE INVENTION

It is therefore an object of the present invention is to provide a color image forming apparatus for preventing the dirt on a grid electrode by the adhesion of floating toner in a pre-secondary-transfer discharging unit, to attain the better performance of dischargation of electrical charges and to obtain a high quality secondary transfer image.

An object of the present invention will be attained by any one of following configurations.

1. A color image forming apparatus comprises a plurality of image carriers, a plurality of a primary transfer units for transferring a toner image formed on the plurality of image carriers onto an intermediate transfer member, a discharging unit for discharging an electrical charge of a toner image transferred by the intermediate transfer member, the discharging unit being disposed between two adjoining image carriers placed along a moving direction of the intermediate transfer member and a secondary transfer unit for transferring a plurality colors of toner images superimposed on the intermediate transfer member onto a transfer material.

2. A color image forming apparatus comprises n units of image carriers, an intermediate transfer member, n units of primary transfer units for transferring toner images of n colors formed-on the image carriers onto the intermediate transfer member, a discharging unit for discharging an electric charge of a toner image transferred on the intermediate transfer member, the discharging unit being disposed at a position just after a first transfer process by any one of the primary transfer units for a first, second, . . . (n−1)th color and a secondary transfer unit for transferring a plurality colors of toner images superimposed on the intermediate transfer member onto a transfer material.

DETAILED DESCRIPTION OF THE PREFERRED EMBODIMENTS

An embodiment of the present invention will be described below. However, the present invention is not limited to the embodiment to be described below.

<A Color Image Forming Apparatus>

Figure 1:
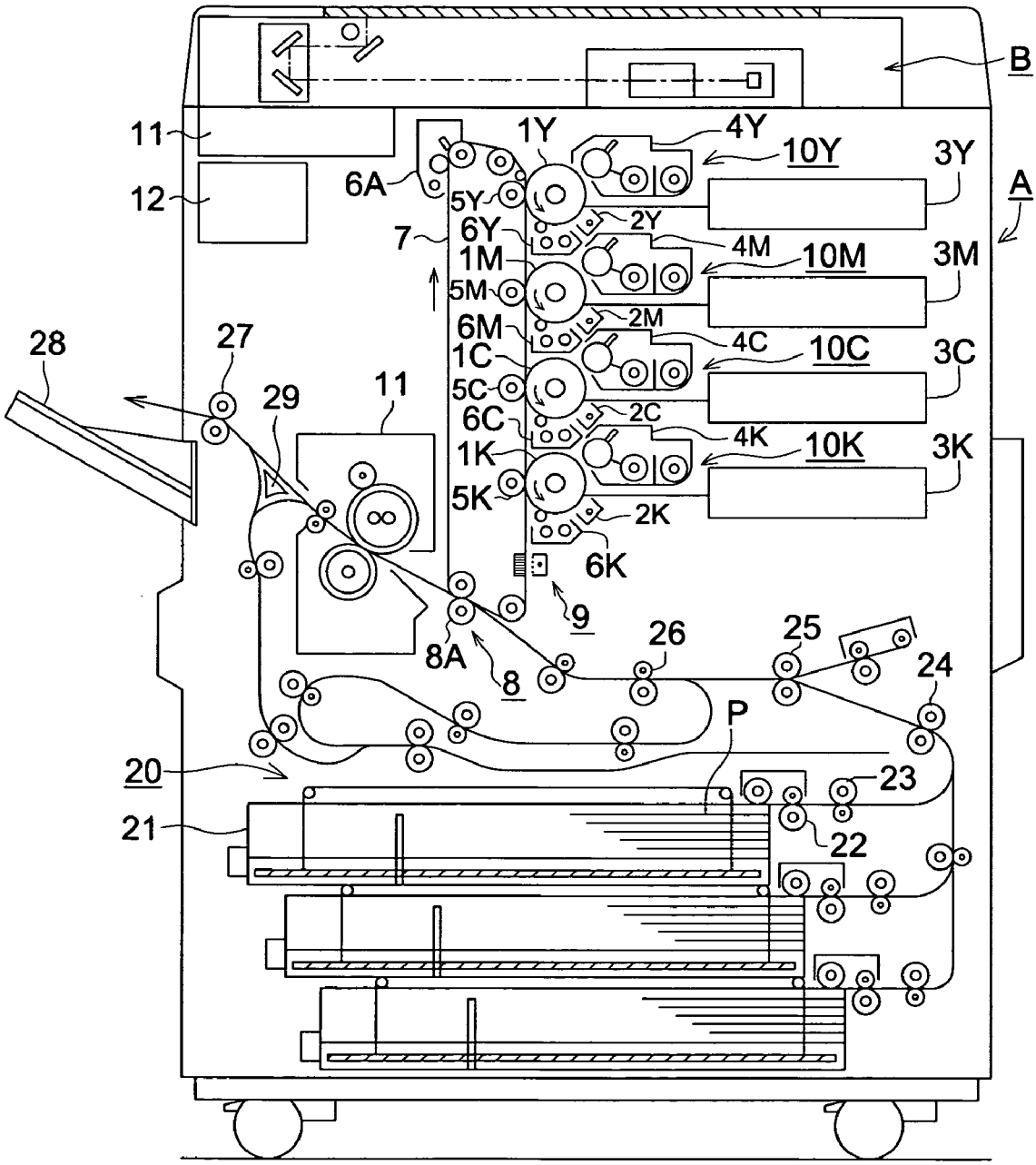
FIG. 1 illustrates a cross sectional view of a total configuration of a color image forming apparatus.

FIG. 1 illustrates a cross sectional view showing a total configuration of an embodiment of a color image forming apparatus A of the present invention.

This color image forming apparatus A is called a tandem type color image forming apparatus. The color image forming apparatus A comprises a plurality of image forming sections 10Y, 10M, 10C and 10K, an intermediate transfer member 7, a primary transfer units 5Y, 5M, 5C and 5K, an intermediate transfer unit configured by a secondary transfer unit 8, a fixing device 11 and a sheet feeding device 20.

An optical system scans and exposes the document placed on a document table provided upper portion of the color image forming apparatus A. Then a line image sensor reads the image on the document. The line sensor converts the optical image into analog electric signals, which will be inputted into exposure units 3Y, 3M, 3C and 3K after being processed by an analog process, an A/D conversion, a shading correction and an image compression process in an image processing section.

An image forming section 10Y for forming a yellow (Y) colored image comprises a charge unit 2Y disposed on the circumference of an image carrier 1Y, an exposing unit 3Y, a developing unit 4Y and a cleaning unit 6Y.

An image forming section 10M for forming a magenta (M) colored image comprises an image carrier 1M, a charging unit 2M, an exposing unit 3M, an exposing unit 4M and a cleaning unit 6M.

An image forming section 10C for forming a cyan (C) colored image comprises an image carrier 1C, a charging unit 2C, an exposing unit 3C, an exposing unit 4C and a cleaning unit 6C.

An image forming section 10K for forming a black (K) colored image comprises an image carrier 1K, a charging unit 2K, an exposing unit 3K, an exposing unit 4K and a cleaning unit 6K.

A latent image forming unit comprises the charging unit 2Y, the exposing unit 3Y, the charging unit 2M, the exposing unit 3M, the charging unit 2C, the exposing unit 3C, the charging unit 2K and the exposing unit 3K.

With regard to the Image carriers 1Y, 1M, 1C and 1K, it is preferable that OPC photosensitive material or aSi photosensitive material, which is well known is used. In the embodiment of the present invention, negatively charged OPC is used.

With regard to the charging units 2Y, 2M, 2C and 2K, a corona charging unit such as a scorotron and a corotron is used. It is preferable that the scorotron charging unit is used.

With regard to the exposing units 3Y, 3M, 3C and 3K, a light emitting element, such as a LED array for emitting lights according to image data is used.

An intermediate transfer member 7 structured in a belt shape is configured by semiconductor. The intermediate transfer member 7 is wound around a plurality of support rollers 71, 72, 73, 74 and a backup roller 75, and is supported so that the intermediate transfer member 7 can circularly move thereabout. In this embodiment, the intermediate transfer member 7 is flatly supported between support rollers 73 and 74.

The first transfer units 5Y, 5M, 5C and 5K simultaneously transfer each color image formed by the image forming units 10Y, 10M, 10C and 10K onto the intermediate transfer member 7 rotating around the support rollers to synthesize a color image on the intermediate transfer member 7 (the primary transfer).

A transfer material P stored in a sheet feeding cassette 21 of a sheet feeding apparatus 20 is fed by a sheet feeding unit (a first sheet feeding section) 22. Then a color image is transferred onto the transfer material P after the transfer material P is passed through feeding rollers 23, 24 and 25, and a registration roller 26 (secondary transfer).

A fixing apparatus 11 applies heat and pressure onto the transfer material P to fix the color toner image (or a monocolor toner image) on the transfer material P. The transfer material onto which the color toner image has been fixed is ejected from a sheet eject roller 27 and placed on the sheet eject tray 28 provided outside on the color image forming apparatus A.

On the other hand, after the second transfer unit 8 has transferred the color image onto the transfer material P, the intermediate transfer member 7 separates the transfer material P with separation by curvature. Then the residual toner left on the intermediate transfer member 7 is removed by a cleaning unit 6A.

<Primary Transfer Unit>

Figure 2:
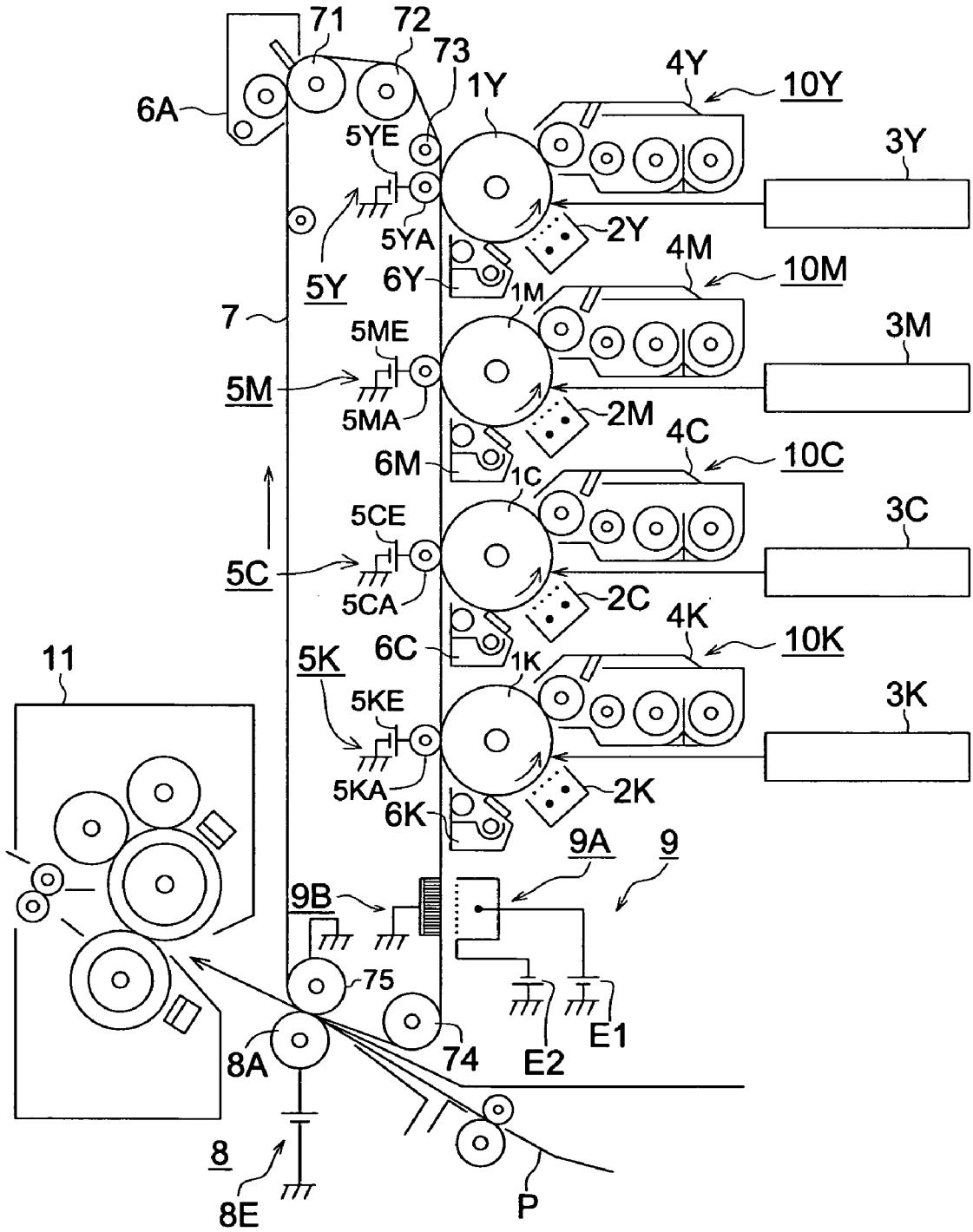
FIG. 2 illustrates a cross sectional view of a main portion of the color image forming apparatus.
Figure 3:
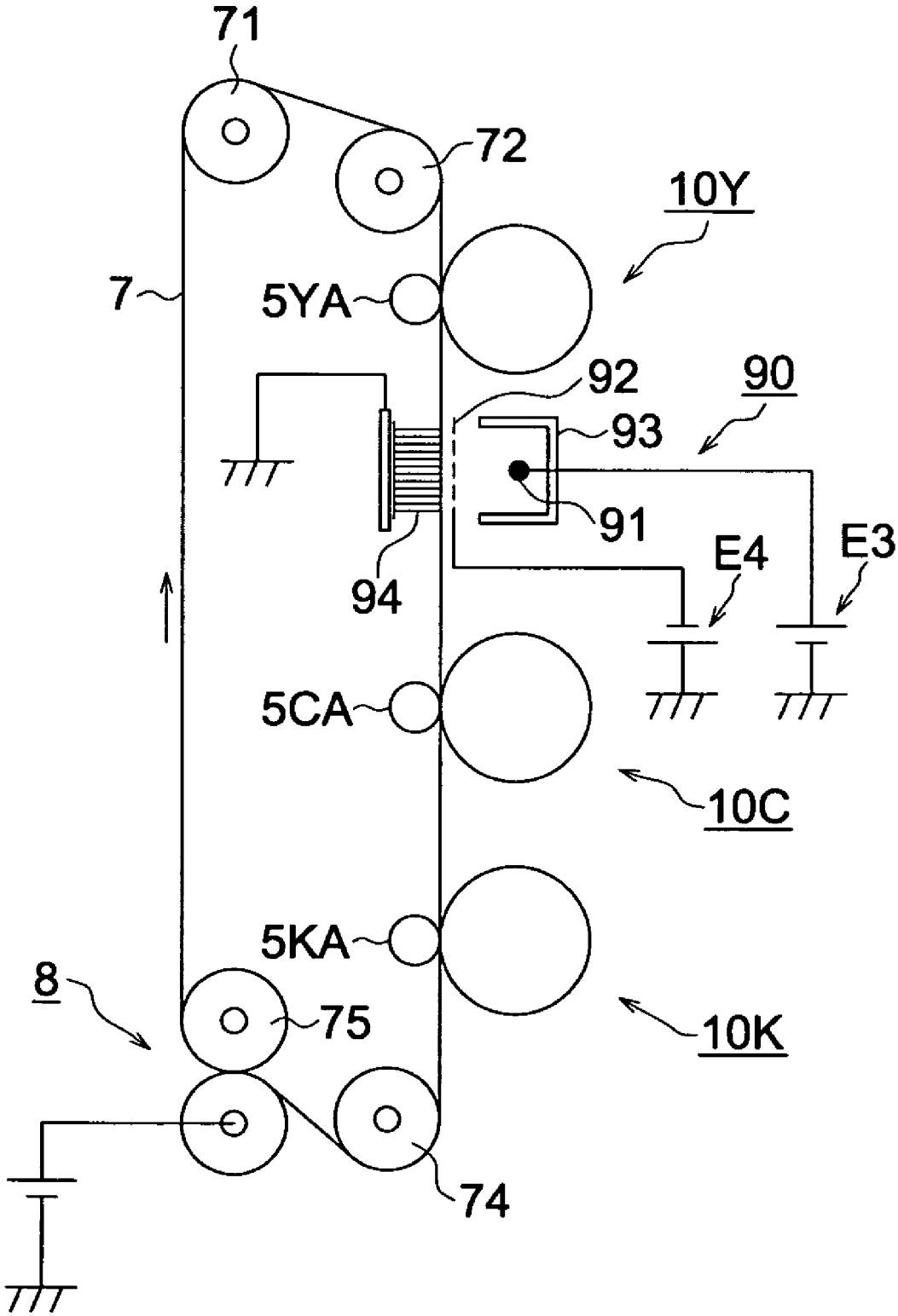
FIG. 3 illustrates a schematic diagram of the main portion of an example 1 of the color image forming apparatus.

FIG. 2 illustrates a cross sectional view of the main portion of the color image forming apparatus A.

The first transfer unit 5Y for transferring a yellow colored image, which comprises a first transfer roller 5YA and a direct current voltage source 5YE for supplying voltage to the first transfer roller 5YA. The first transfer roller 5YA is opposed to the image carrier 1Y through the intermediate transfer member 7 and contacting to the inside of the intermediate transfer member 7. The direct current voltage source 5YE is grounded.

The first transfer unit 5M for transferring a magenta colored image, which comprises a first transfer roller 5MA and a direct current voltage source 5ME for supplying voltage to the first transfer roller 5MA. The first transfer roller 5MA is opposed to the image carrier 1M through the intermediate transfer member 7 and contacting to the inside of the intermediate transfer member 7. The direct current voltage source 5ME is grounded.

The first transfer unit 5C for transferring a cyan colored image, which comprises a first transfer roller 5CA and a direct current voltage source 5CE for supplying voltage to the first transfer roller 5CA. The first transfer roller 5CA is opposed to the image carrier 1C through the intermediate transfer member 7 and contacting to the inside of the intermediate transfer member 7. The direct current voltage source 5CE is grounded.

The first transfer unit 5K for transferring a black colored image, which comprises a first transfer roller 5KA and a direct current voltage source 5KE for supplying voltage to the first transfer roller 5KA. The first transfer roller 5KA is opposed to the image carrier 1K through the intermediate transfer member 7 and contacting to the inside of the intermediate transfer member 7. The direct current voltage source 5KE is grounded.

Each direct current voltage sources 5YE, 5ME, 5CE and 5KE respectively supply current of 40 μA and voltage of 1.5 kV to the first transfer units 5Y, 5M, 5C and 5K.

The first transfer units 5Y, 5M, 5C and 5K are arranged to move away from the inside surface of the intermediate transfer member 7 by a driving unit (not shown) while the first transfer units are not used for the first transfer operation.

<Secondary Transfer Unit>

A secondary transfer unit 8 comprises a backup roller 75, a secondary transfer roller 8A and a direct current voltage source 8E. The backup roller 75 structured by a conductive member opposes to the secondary transfer roller 8A through the intermediate transfer member 7 and contacts with the internal surface of the intermediate transfer member 7.

The secondary transfer roller 8A is connected with a direct current voltage source 8E for inputting direct current voltage to the secondary transfer roller 8A. The direct current voltage source 8E inputs current 50 μA and voltage +3 kV onto the secondary transfer unit 8. The direct current voltage source 8E applies reverse bias voltage to move the residual toner adhered on the secondary transfer roller 8A contacting with the intermediate transfer member 7 to the intermediate transfer member 7 to clean the secondary transfer roller 8A.

The backup roller 75 of the secondary transfer unit 8 has substantially the same configuration of the first transfer rollers 5YA, 5MA, 5CA and 5KA, and contacts with the inside surface of the intermediate transfer member 7 with pressure. The backup roller 75 having a conductive characteristic comprises a main body of a roller and an elastic layer formed on the surface of the main body of the roller.

A single layer or a multiple layer belt having a material such as polyamide or polyimide structures the intermediate transfer member 7. The single layer or a multi layer belt has a volume resistivity of $10^7$-$10^{12}$ Ωcm.

The intermediate transfer member 7 is cleaned while passing through the cleaning unit 6A after the secondary transfer unit 8 has transferred the image onto the transfer material P.

The secondary transfer roller 8A is moved away from the outer surface of the intermediate transfer member 7 by a driving unit (not shown) while the secondary roller is not used for the secondary transfer operation.

<Pre-Secondary-transfer Discharging Unit>

As illustrated in FIG. 2, a pre-secondary-transfer discharging unit 9 is provided at the position where the intermediate transfer member 7 is supported with a flat surface shape between the first transfer unit 5K and a support roller 74, which are provided along with the intermediate transfer member 7.

The pre-secondary-transfer discharging unit 9 comprises a discharger 9A provided in the image carrier side of the intermediate transfer member 7 and an opposite electrode 9B provided the inside surface side of the intermediate transfer member 7 shaped in an endless belt.

In the color image forming apparatus of an intermediate transfer method, even though the first transfer performance is good, there is a case that a high quality image cannot be obtained when the secondary transfer is not good in the second color. The reason why a high quality image cannot be obtained is that the toner image formed on the intermediate transfer member 7 has toner widely spread over layers from the first layer to the fourth layer in maximum and the optimization of each secondary transfer condition corresponding to the adhesion amount of each layer becomes unbalance.

In response to this problem, it becomes possible to satisfy the secondary transfer performance by discharging the toner image formed on the intermediate transfer member 7 and adjusting the electrical charge amount to satisfy the secondary transfer performance against the toner adhesive amount widely spread over the layers from the first layer to the fourth layer.

However, as the process speed of the color image forming apparatus has been improved, in order to secure the dischargation, the length of the discharger 9A of the pre-secondary-transfer dischargation unit 9 in the secondary scanning direction (the running direction of the intermediate transfer member 7) must be extended. Accordingly, the length of the opposite electrode 9B must be extended.

A roller has been adopted for the opposite electrode 9B for many cases. In order to improve the process speed of the color image forming apparatus, it is necessary not only to widen the contact length with the intermediate transfer member 7 but also to set the optimum distance between the intermediate transfer member 7 and the pre-secondary-transfer discharging unit 9.

In order to solve these two problems, it is necessary to extend the outer diameter of the support roller 74 and to widen the winding angle of the intermediate transfer member 7 having a belt shape. However, there are problems that the size of the apparatus becomes large and the manufacturing cost goes up.

In order to improve these problems, the opposed electrode 9B of a conductive blush or a conductive forming material is arranged to be grounded while contacting with the surface of the intermediate transfer member 7. Based on these solutions, the improvement of the dischargation efficiency, which is better than that of conventional solution has been attained.

<Discharger 9A>

The discharger 9A is a scorotron discharger configured by a discharging electrode, a grid electrode and a case.

The discharging electrode is connected to a direct current voltage source E1. The grid electrode is so disposed as to oppose to the belt surface of the intermediate transfer member 7 with keeping a predetermined distance. The grid electrode is connected to the direct current voltage source E2. The case is arranged to keep the same voltage as the grid electrode via a circuit (not shown).

A wire material of tungsten, stainless steal and gold having a diameter of 20-150 μm may configure the discharging electrode. However, a wire material having the surface covered by gold preferably configures the discharging electrode. The wire itself may be structured by gold or may be structured by a base member of stainless steal or tungsten, which is covered with gold thereon. The thickness of the gold membrane is preferably 1 μm-5 μm in average thickness of the membrane from the viewpoint of the removal efficiency of substance generated by discharging such as ozone and a manufacturing cost.

With regard to the grid electrode, a wire type grid, a plate shaped grid formed from a pattern shape into which a metal plate is processed by an etching and a plate type grid onto which gold plating has been applied are used.

The discharger 9A is arranged so that the direct current voltage of 0 to +5 kV, which causes reverse polarity discharge of the toner is applied to the discharging electrode, and direct current voltage of 0 to −300 V is applied to the grid electrode. As an example, voltage of +5 kV is applied to the discharging electrode and voltage of −100 V is applied to the grid electrode.

In the example of the present invention, the direct current voltage of 0 to +5 kV, which causes reverse polarity discharge of the toner is applied to the discharging electrode, and direct current voltage of 0 to −300 V is applied to the grid electrode.

In the example, which will be described later, voltage of +4 kV is applied to the discharging electrode of the pre-second-transfer discharging unit 9 and voltage of −50 V is applied to the grid electrode.

<Opposite Electrode 9B>

An opposite electrode 9B configured by a conductive blush and a pressure contact release mechanism for releasing pressure contact of the conductive blush is provided inside surface of the intermediate transfer member 7 opposed to the pre-secondary-transfer discharging unit 9. The conductive blush is contacted with the inside surface of the intermediate transfer member 7 with pressure and grounded.

It is preferable that the conductive blush comprises a conductive resin material such as acryl, nylon and polyester. It is also preferable that the wire diameter 0.111 tex to 0.778 tex, where tex is proposed by ISO for the unit of measurement of the diameter of wire by representing the number of the length, which can be prolonged from a predetermined fixed weight material of the wire, the blush density is 12000 pieces of hair/cm$^2$ to 7700 pieces of wire/cm$^2$ and the original sting resistivity is $10^0$ to $10^5$ Ωcm.

EXAMPLES

Examples of the present invention will be described below. However, the present invention is not limited to the examples. In this example, an image has been formed by the color image forming apparatus A including the first transfer units 5Y, 5M, 5C and 5K, and the secondary transfer unit 8 illustrated in FIG. 8.

[Image Forming Condition]

Image forming apparatus: A tandem type full color copier (Konica Minolta 8050 (Trademark of Konica Minolta Co., Ltd) with some modifications), the continuous copy speed in full color corresponds to the speed of 51 piece of paper sheets (A4 size) per minute.

Image carrier 1Y, 1M, 1C and 1K: The outer diameter is ϕ60 mm.

Transfer member conveyance line speed: 220 mm/sec

Developing agent: Average particle diameter of the carrier; 20-60 μm, average particle diameter of the polymerized toner; 3-7 μm Charging unit 2Y, 2M, 2C and 2K: electrostatic charge voltage VO is −700 V (variable: the number in the left is a nominal value)

Exposing unit 3Y, 3M, 3C and 3K: semiconductor laser (wavelength 780 nm), surface voltage of an image forming member when being exposed Vi is −50 V.

Developing unit 4Y, 4M, 4C and 4K: Developing sleeve voltage Vdc is −500 V (variable: the number in the left is a nominal value), Developing bias voltage alternate voltage element Vac is 1 kvp-p with a rectangular waveform of frequency 5 kHz.

First transfer rollers 5YA, 5MA, 5CA and 5KA: Conductive rollers are used, roller pressure 10 N, transfer current 40 μA, and transfer voltage +1.5 kV is applied.

In this example, the color image forming apparatus A including the secondary transfer unit 8 illustrated in FIGS. 1-2 forms the image.

The secondary transfer unit: A configuration for putting the intermediate transfer unit 8 between the backup roller 75 and the secondary transfer roller 8A is adopted; Electrical resistances are both $1\times10^7$Ω; apply a predetermined current value selected from a current value table into which a matrix formed by temperature/humidity and a counter.

Pressure force F: 50 N (Newton), Nip width in a transfer material conveyance direction: 3 mm Elastic layer of secondary transfer roller 8A: Semi-conductive NBR solid rubber (acrylonitrile•butadiene-rubber), volume resistance $4\times10^7$Ω, and outer diameter ϕ40 mm.

Length in the axis direction of elastic layer of secondary transfer roller 8A: LA=150 mm, LB=250 mm, LC=330 mm Intermediate transfer member 7: Polyimide, seamless semiconductive belt (volume resistivity $10^9$ Ωcm), tightly stretched tension 50N, line velocity 220 mm/sec Adhesion amount of toner on the intermediate transfer member 7 from right after passing through the image carrier 1K to the secondary transfer unit 8: 10 g/M$^2$ Height of toner on the intermediate transfer member 7 from right after passing through the image carrier 1K to the secondary transfer unit 8: 30 μm Reverse-bias-applying-cleaning-control against secondary transfer roller 8A: The cleaning of secondary transfer roller 8A is performed by charging + polarity electric charge against the secondary roller 8A for 1 second while conducting transfer to the transfer material P (when setting the normal conveyance line speed V1 of transfer material P to 220 mm/sec, (V1=V2), time period corresponding to rotate the secondary roller 8A having the outer diameter of 40 mm twice), when conducting continuous print operation, a toner image is transferred onto the secondary roller 8A from the back edge of the transfer material P.

<Discharging Unit>

A discharging unit 90 comprises a discharger disposed in the image carrier side of the intermediate transfer member 7 and an opposite electrode disposed internal surface side of the intermediate transfer member 7 having an endless belt shape.

<Discharger>

A discharger is a scorotron discharger having a discharging electrode 91, a grid electrode and a side plate 93.

The discharging electrode 91 is connected to a direct current voltage source E3. The grid electrode 92 opposes to the belt surface of the intermediate transfer member 7 with a predetermined distance and is connected with the direct current voltage source E4. The side plate 93 is connected with the grid 92 through a circuit, which is not shown to keep the same voltage of the gird.

A wire material of tungsten, stainless steal and gold having a diameter of 20-150 μm may configure the discharging electrode 91. However, a wire material having the surface covered by gold preferably configures the discharging electrode. The wire material itself may be structured by gold or may be structured by a base member of stainless steal or tungsten, which is covered with gold thereon. The thickness of the gold membrane is preferably 1 μm-5 μm in average thickness of the membrane from the viewpoint of the removal efficiency of substance generated by discharging such as ozone and a manufacturing cost.

With regard to the grid electrode 92, a wire type grid, a plate shaped grid formed from a pattern shaped into which a metal plate is processed by an etching and a plate type grid onto which a gold has been flashed are used.

The discharging unit 90 is arranged so that the direct current voltage of 0 to +5 kV, which causes reverse polarity discharge of the toner is applied to the discharging electrode 91, and direct current voltage of 0 to −300 V is applied to the grid electrode 92. As an example, voltage of +5 kV is applied to the discharging electrode 91 and voltage of −100 V is applied to the grid electrode.

In the example of the present invention, the direct current voltage of 0 to +5 kV, which causes reverse polarity discharge of the toner is applied to the discharging electrode 91, and direct current voltage of 0 to −300 V is applied to the grid electrode 92.

In the example, voltage of +4 kV is applied to the discharging electrode 91 of the discharging unit 90 and voltage of −50 V is applied to the grid electrode 92.

The voltage of a side plate 93 has been set at the same voltage of the grid 92. The distance between the grid electrode 92 and the intermediate transfer member 7 is set at 1 mm and arrange to be parallel.

The width of the discharging electrode 91 (the length of the intermediate transfer member 7 in the running direction) is set 30 mm and the length in the longitudinal direction (a length crossing at right angles with the intermediate transfer member 7) is set 320 mm.

<Opposite Electrode 9B>

An opposite electrode 9B configured by a conductive blush 94 and a pressure contact release mechanism for releasing pressure contact of the conductive blush 94 is provided inside surface of the intermediate transfer member 7 opposed to the discharging unit 90. The conductive blush 94 is contacted with the inside surface of the intermediate transfer member 7 with pressure and grounded.

The conductive blush comprises an original wire having resistance of $10^2\Omega$, a diameter of 3 deniers (1 denier is a unit denoting a wire diameter, the wire having a length of 4560 m and weight is 50 mg), a density of 200 kF/inch$^2$ (F denotes filament number, 1 inch denotes 25.4 mm) and the length of the wire being 4 mm. The conductive blush 94 is grounded.

The width of the conductive blush 94 of the opposite electrode 9B (the length in the running direction of the intermediate transfer member 7) is set at 30 mm and the longitudinal length (the length crossing at right angles with the running direction of the intermediate transfer member 7) is set at 320 mm.

<Experimental Conditions>

With regard to the method for confirming the effect of the present invention, a solid image onto which a magenta toner image and a cyan toner image have been superimposed has been outputted. When the dischargation effect is insufficient, transfer unevenness of the rear surface occurs when the solid image onto which a magenta toner image and a cyan toner image have been superimposed has been outputted under the condition of low temperature and low humidity.

With regard to the method for confirming the effect of countermeasures against the dirt of the grid electrode 92, 1000 pieces of paper sheet onto which a character (6 point character) image onto which a magenta toner image and a cyan toner image are superimposed are continuously outputted. Then a microscope has observed the adhesive status of the floating toner to the grid electrode 92 after the print output has been completed.

Example 1

The color image forming apparatus of example 1 is an apparatus being equal to the color image forming apparatus illustrated in FIG. 2, from which the image forming section 10M, which is the second step from the top has been removed and the discharging unit 90 is disposed instead of the image forming section 10M. A magenta colored developing agent was inputted to the image forming section 10Y located in the first stage from the top and a cyan colored developing agent was inputted to the image forming section 10C located in the third stage from the top.

+200 μA current was inputted to the discharging electrode 91 of the discharging unit 90 and −50 V voltage was applied to the grid electrode 92.

The transfer image evaluation results of the color image forming apparatus having the configuration described above will be shown in Table 1. The toner adhesive ratio to the grid electrode 92 was observed right under the downstream of the discharging electrode 91.

TABLE 1

| | Magenta + Cyan Transfer unevenness | Toner adhesive rate to Grid Electrode 92 | Magenta halftone Image Roughness |
|---|---|---|---|
| Example 1 | Non-occurrence | About 30% | Non-occurrence |
| Example 2 | Non-occurrence | About 30% | Non-occurrence |
| Example 3 | Non-occurrence | About 15% | Non-occurrence |
| Comparison Example | Non-occurrence | About 60% | Image roughness occurs |

According to the example 1 in Table 1, transfer unevenness of magenta plus cyan did not concur. The toner adhesion area ration to the grid electrode 92 (toner adhesive coverage ratio) was about 30% and the image roughness of the magenta halftone image did not occur. As a result, good result has been obtained.

Example 2

Figure 4:
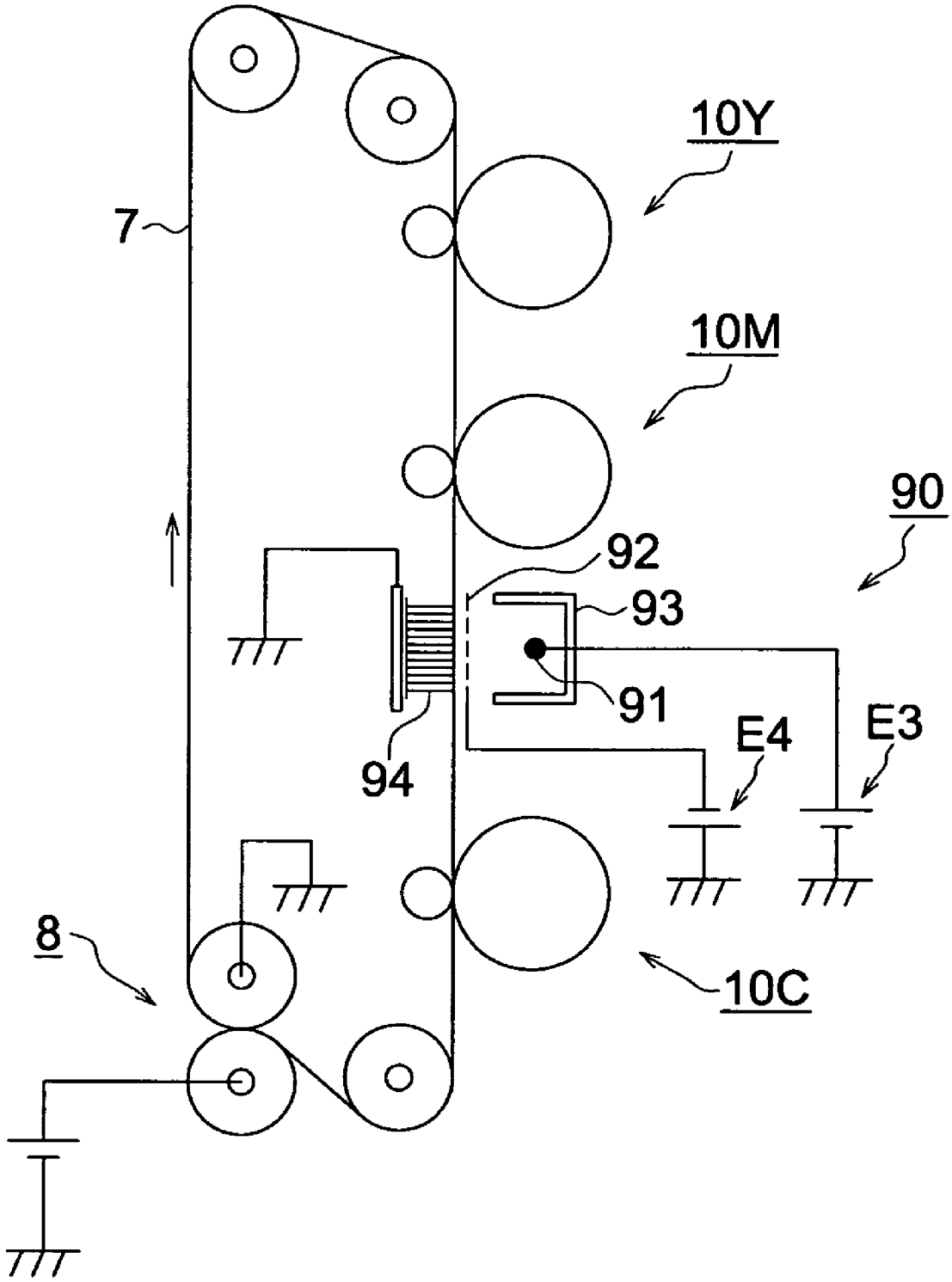
FIG. 4 illustrates a schematic diagram of the main portion of an example 2 of the color image forming apparatus.

FIG. 4 illustrates a schematic diagram of the main section of the color image forming apparatus of the Example 2.

The color image forming apparatus of example 2 is an apparatus being equal to the color image forming apparatus illustrated in FIG. 2, from which the image forming section 10C, which is the third step from the top has been removed and the discharging unit 90 is disposed instead of the image forming section 10C. A magenta colored developing agent was inputted to the image forming section 10Y located in the first stage from the top and a cyan colored developing agent was inputted to the image forming section 10K located in the fourth stage from the top.

+200 μA current was inputted to the discharging electrode 91 of the discharging unit 90 and −50 V voltage was applied to the grid electrode 92.

The transfer image evaluation results of the color image forming apparatus having the configuration described above will be shown in Table 1. The toner adhesive ratio to the grid electrode 92 was observed right under the downstream of the discharging electrode 91.

According to the example 2 in Table 1, transfer unevenness of magenta plus cyan did not concur. The toner adhesion area ratio to the grid electrode 92 was about 30% and the image roughness of the magenta halftone image did not occur. As a result, good result has been obtained.

Example 3

Figure 5:
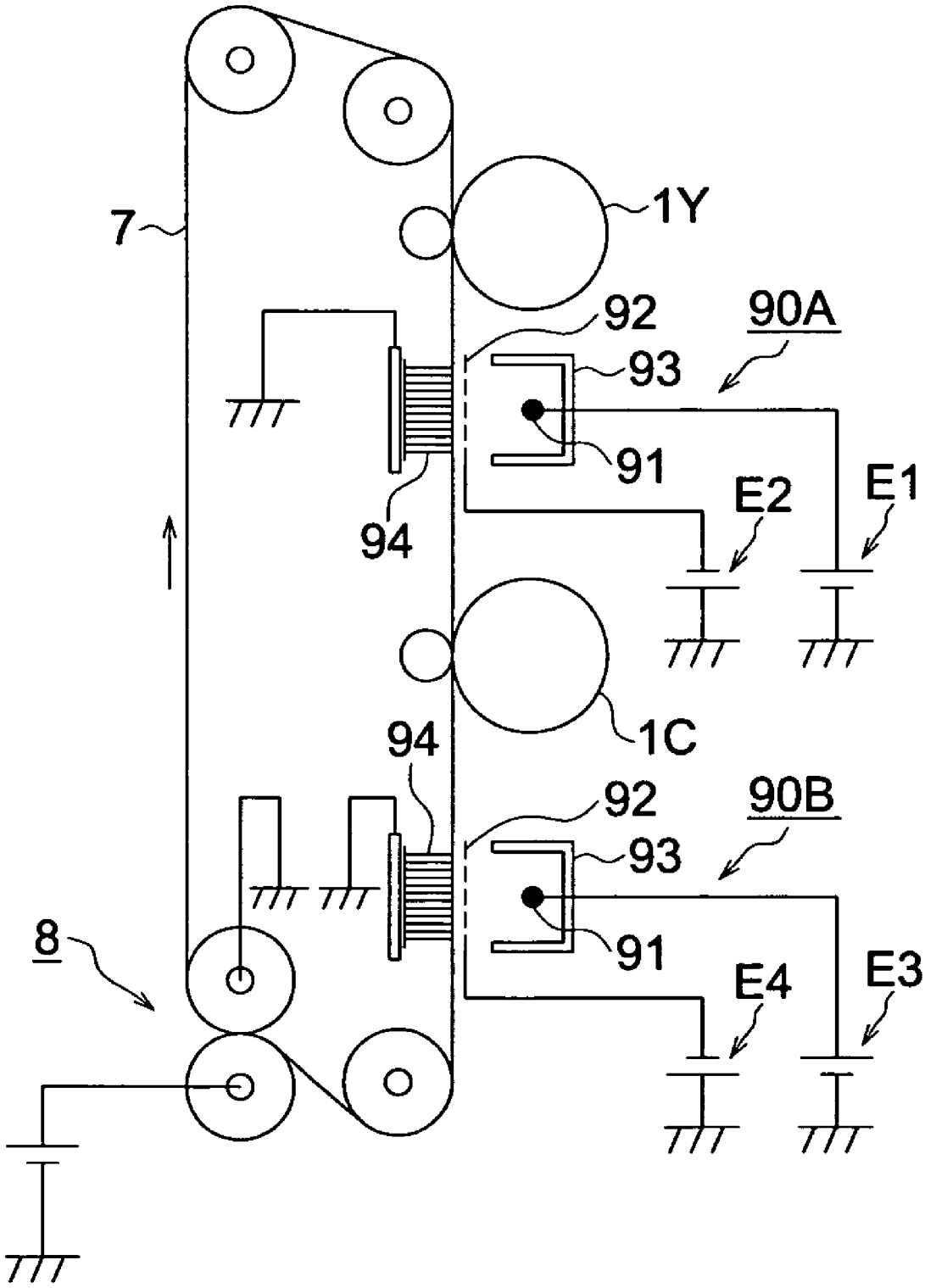
FIG. 5 illustrates a schematic diagram of the main portion of an example 3 of the color image forming apparatus.

FIG. 5 illustrates a schematic diagram showing the main section of the color image forming apparatus of the example 3.

The color image forming apparatus of example 3 is an apparatus being equal to the color image forming apparatus illustrated in FIG. 2, from which the image forming section 10M, which is the second step from the top has been removed and the discharging unit 90A is disposed instead of the image forming section 10M and further the image forming section 10K, which is the fourth step from the top has been removed and the discharging unit 90B is disposed instead of the image forming section 10K. The first discharging unit 90A and the second discharging unit 90B have the same configuration elements. Thus the configuration elements have the same code.

The magenta color developing agent was inputted to the image forming section 10Y of the first step from the top and cyan color developing agent was inputted to the image forming section 10C of the third steps from the top.

+200 μA current was inputted to the discharging electrode 91 of the first discharging unit 90A and −50 V voltage was applied to the grid electrode 92. +200 μA current was inputted to the discharging electrode 91 of the second discharging unit 90B and −50 V voltage was applied to the grid electrode 92.

The transfer image evaluation of the configuration of the color image forming apparatus described above will be described in Table 1.

According to the example 3 in Table 1, the transfer unevenness with magenta plus cyan color did not occur. The toner adhesive ratio to the grid electrode 92 was 15%. The image roughness with a magenta color halftone image did not occur. As a result, good result has been obtained.

Comparative Example

Figure 6:
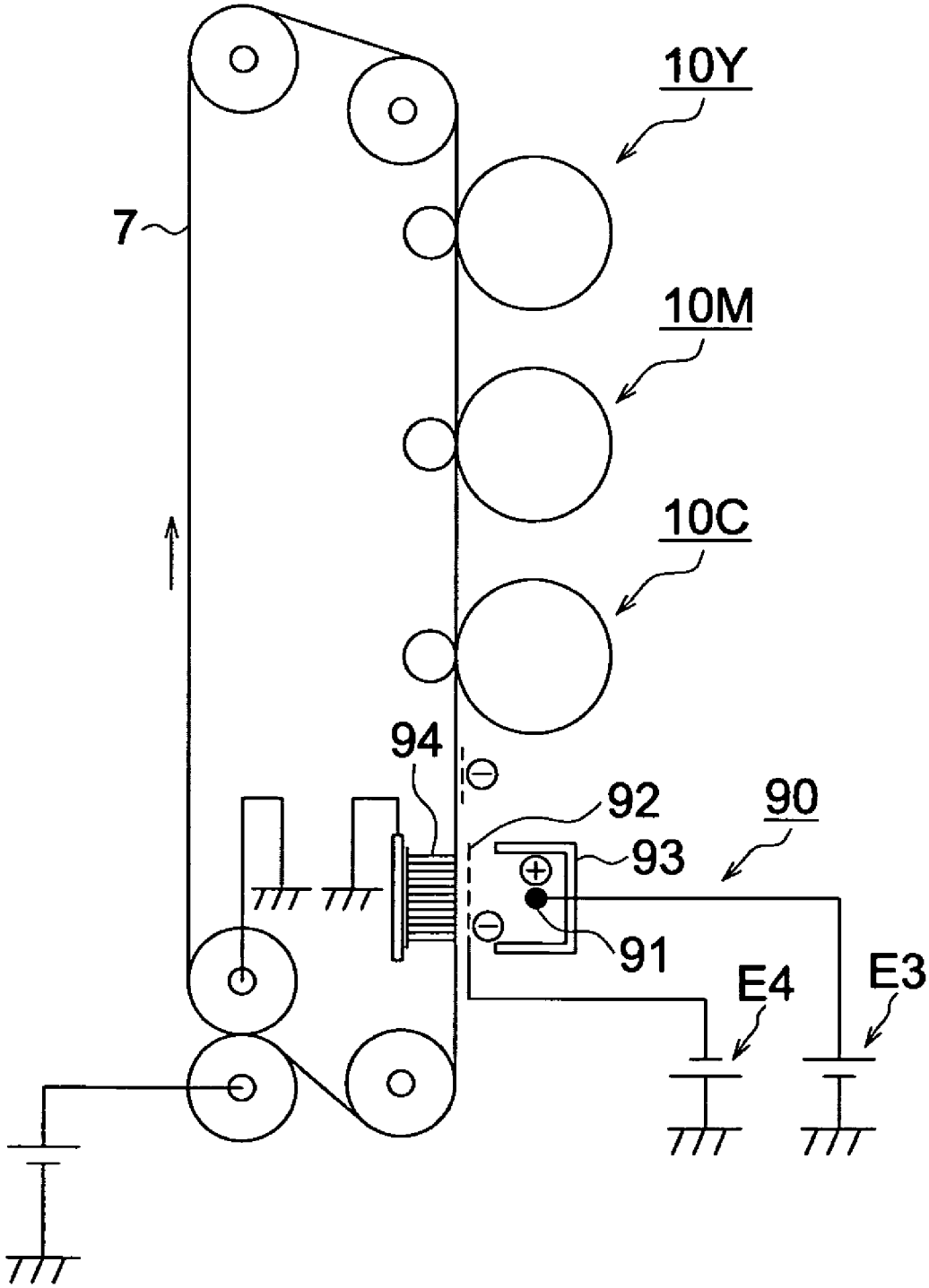
FIG. 6 illustrates a schematic diagram of the main portion of a comparison example of the color image forming apparatus.

FIG. 6 illustrates the schematic diagram of the main portion of the color image forming apparatus of the comparative example.

The color image forming apparatus of the comparative example is an apparatus being equal to the color image forming apparatus illustrated in FIG. 2, from which the image forming section 10K, which is the fourth step from the top has been removed and the discharging unit 90 is disposed instead of the image forming section 10K.

The magenta color developing agent was inputted to the image forming section 10M of the second step from the top and cyan color developing agent was inputted to the image forming section 10C of the third steps from the top.

+200 μA current was inputted to the discharging electrode 91 of the discharging unit 90 and −50 V voltage was applied to the grid electrode 92.

The transfer image evaluation of the configuration of the color image forming apparatus described above will be described in Table 1.

In the comparative example of Table 1, the transfer unevenness of magenta color plus cyan color did not occur. However, the toner adhesive ratio to the grid electrode is 60%, which is quite large number and the magenta color halftone image roughness occurred.

Experimental Results

A toner image on the lower layer of superimposed image can be discharged by conducting dischargation just after the primary transfer other than the transfer operation at the most downstream. The total electric charge of toner layer can be suppressed by charging the toner image formed on the most upper side layer with reverse polarity while preventing the grid electrode 92 of the discharging unit 90 from getting dirt. As a result, the secondary transfer capability has been improved.

Accordingly, satisfactory second transfer capability can be attained and high quality color image can be obtained by disposing the discharging unit 90 at least at one position in any one of places being downstream of the image carriers 1Y, 1M and 1C of the color image forming apparatus illustrated in FIG. 1, which are the places as shown in examples 1, 2 and 3.

Further, the total electric charges of the toner images, which have been superimposed, can be suppressed. Thus floating toner image adhesion to the grid electrode has been lowered.

Disposing Examples of Discharging Unit 90

Figure 7:
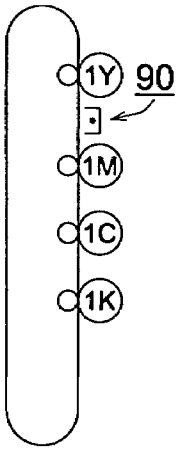
FIGS. 7(*a*)-7(*n*) illustrate schematic diagrams of various disposal examples of discharging units.
Figure 7:
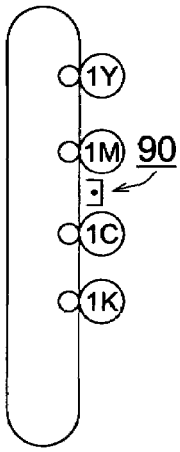
Figure 7:
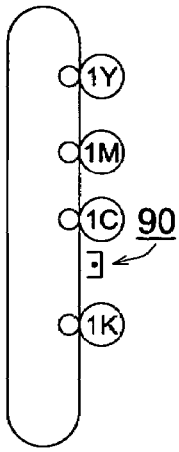
Figure 7:
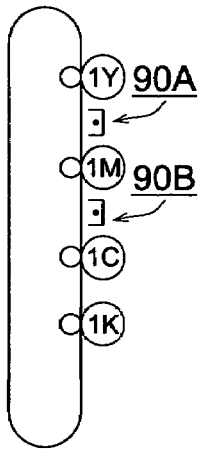
Figure 7:
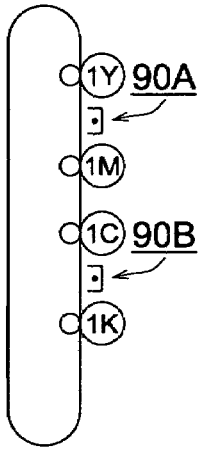
Figure 7:
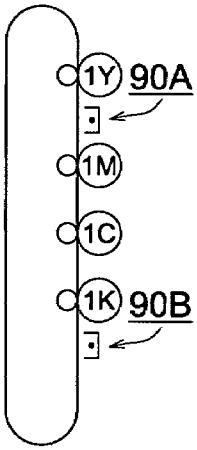
Figure 7:
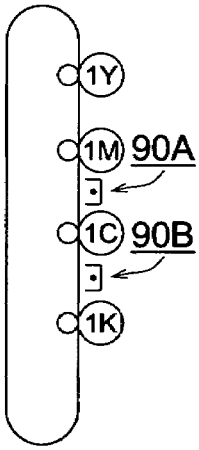
Figure 7:
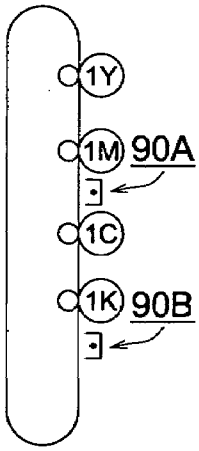
Figure 7:
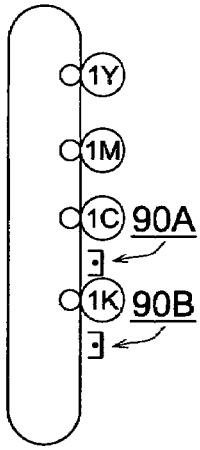
Figure 7:
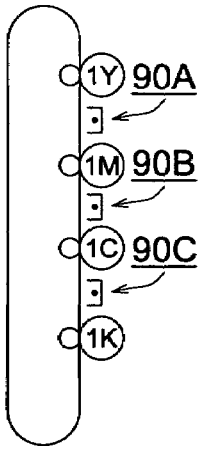
Figure 7:
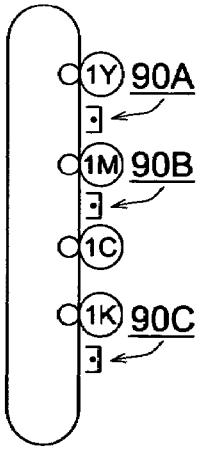
Figure 7:
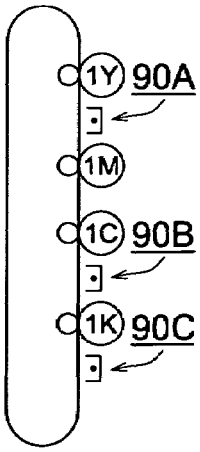
Figure 7:
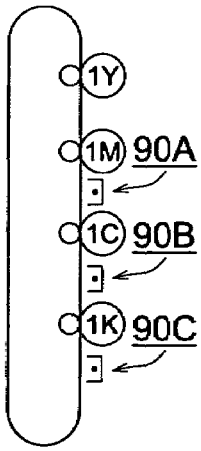
Figure 7:
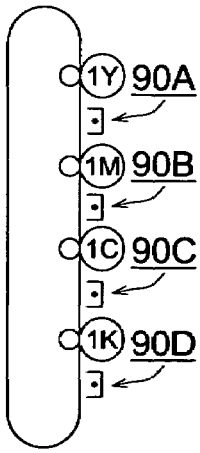

FIGS. 7(*a*)-7(*n*) illustrate schematic diagrams of various disposing examples of the discharging unit 90.

FIGS. 7(*a*)-7(*c*) illustrate disposing examples, in which the discharging unit 9 is disposed downstream of any one location of the image carriers 1Y, 1M and 1C.

FIGS. 7(*d*)-7(*i*) illustrate disposing examples, in which the discharging units 90A and 90B are disposed downstream of any two locations of the image carriers 1Y, 1M and 1C.

FIGS. 7(*j*)-7(*m*) illustrate disposing examples, in which the discharging units 90A, 90B and 90C are disposed downstream of any three locations of the image carriers 1Y, 1M and 1C.

FIGS. 7(*n*) illustrates disposing example, in which the discharging units 90A, 90B, 90C and 90D are disposed downstream of all four locations of the image carriers 1Y, 1M, 1C and 1K.

In the embodiments of the present invention, with regard to the intermediate transfer member 7, the example having an intermediate transfer belt was described. However, the present invention can apply to apparatuses having other types intermediate transfer members such as an intermediate transfer drum.

What is claimed is:

1. A color image forming apparatus comprising:

(a) a plurality of image carriers each on which a toner image having a color different from each other is formed;

(b) an intermediate transfer member;

(c) a plurality of a primary transfer units each transferring a toner image formed on each of the plurality of image carriers onto the intermediate transfer member;

(d) a discharging unit provided between two adjoining image carriers in a moving direction of the intermediate transfer member, which discharges an electrical charge of a toner image transferred on the intermediate transfer member;

(e) a secondary transfer unit transferring a plurality colors of toner images which have been superimposed on the intermediate transfer member onto a transfer material, and wherein the discharging unit discharges an electric charge of the toner image corresponding to a lower layer of a plurality of layers which have been superimposed on the intermediate transfer member.

2. The color image forming apparatus of claim 1, further comprising a second discharging unit provided downstream of a most-downstream primary transfer unit and upstream of the secondary transfer unit with respect to the moving direction of the intermediate transfer member.

3. A color image forming apparatus comprising:

(a) n units of image carriers;

(b) an intermediate transfer member;

(c) n units of primary transfer units which transfers toner images of n colors formed on the image carriers onto the intermediate transfer member;

(d) a discharging unit which discharges an electric charge of a toner image transferred on the intermediate transfer member, the discharging unit being disposed at a position just after a first transfer process by any one of the primary transfer units for a first to (n−1)th color;

(e) a secondary transfer unit which transfers a plurality colors of toner images which have been superimposed on the intermediate transfer member onto a transfer mater; and wherein the discharging unit discharges an electric charge of the toner image corresponding to a lower layer of a plurality of layers which have been superimposed on the intermediate transfer member.

4. The color image forming apparatus of claim 3, wherein the discharging unit is disposed upstream of the primary transfer unit at least for an n-th color.

5. The color image forming apparatus of claim 3, further comprising a second discharging unit provided downstream of the first transfer unit for an n-th color.

6. A color image forming apparatus comprising:

(a) a plurality of image carriers each on which a toner image having a color different from each other is formed;

(b) an intermediate transfer member;

(c) a plurality of a primary transfer units each transferring a toner image formed on each of the plurality of image carriers onto the intermediate transfer member;

(d) a discharging unit provided between two adjoining image carriers in a moving direction of the intermediate transfer member, which discharges an electrical charge of a toner image transferred on the intermediate transfer member;

(e) a secondary transfer unit transferring a plurality colors of toner images which have been superimposed on the intermediate transfer member onto a transfer material;

wherein the discharging unit is a scorotron discharger; and wherein the scorotron discharger comprises a discharging electrode to which a voltage having a polarity reverse to an electric charge of the toner image that has been carried on the intermediate transfer member, is applied, and a grid electrode to which a voltage having the same polarity as that of the electric charge of the toner image, is applied.

7. The color image forming apparatus of claim 6, further comprising a second discharging unit provided downstream of a most-downstream primary transfer unit and upstream of the secondary transfer unit with respect to the moving direction of the intermediate transfer member.

8. A color image forming apparatus comprising:

(a) n units of image carriers;

(b) an intermediate transfer member;

(c) n units of primary transfer units which transfers toner images of n colors formed on the image carriers onto the intermediate transfer member;

(d) a discharging unit which discharges an electric charge of a toner image transferred on the intermediate transfer member, the discharging unit being disposed at a position just after a first transfer process by any one of the primary transfer units for a first to (n−1)th color;

(e) a secondary transfer unit which transfers a plurality colors of toner images which have been superimposed on the intermediate transfer member onto a transfer material wherein the discharging unit is a scorotron discharger; and wherein the scorotron discharger comprises a discharging electrode to which a voltage having a polarity reverse to an electric charge of the toner image that has been carried on the intermediate transfer member, is applied, and a grid electrode to which a voltage having the same polarity as that of the electric charge of the toner image, is applied.

9. The color image forming apparatus of claim 8, wherein the discharging unit is disposed upstream of the primary transfer unit at least for an n-th color.

10. The color image forming apparatus of claim 8, further comprising a second discharging unit provided downstream of the first transfer unit for an n-th color.

* * * * *